US010214329B2

(12) United States Patent
Kalokhe et al.

(10) Patent No.: US 10,214,329 B2
(45) Date of Patent: Feb. 26, 2019

(54) INSERT TO REDUCE LIKELIHOOD OF CONTAMINATION THROUGH BACKWASH AND CONTAINER WITH SAME

(71) Applicant: ABCD CAPITAL LLC, Chicago, IL (US)

(72) Inventors: Kapil Kalokhe, Chicago, IL (US); Aarti Mehta, Chicago, IL (US); Jon Appleby, Acton, MA (US); Jon Gowa, Medford, MA (US); Thomas Dutremble, Boston, MA (US)

(73) Assignee: ABCD CAPITAL LLC, Chicago, IL (US)

( * ) Notice: Subject to any disclaimer, the term of this patent is extended or adjusted under 35 U.S.C. 154(b) by 0 days.

(21) Appl. No.: 15/621,340

(22) Filed: Jun. 13, 2017

(65) Prior Publication Data

US 2017/0355494 A1 Dec. 14, 2017

Related U.S. Application Data

(60) Provisional application No. 62/409,463, filed on Oct. 18, 2016, provisional application No. 62/349,733, filed on Jun. 14, 2016.

(51) Int. Cl.
*B65D 47/12* (2006.01)
*B65D 47/20* (2006.01)
(Continued)

(52) U.S. Cl.
CPC ..... *B65D 47/123* (2013.01); *B65D 47/043* (2013.01); *B65D 47/20* (2013.01); *B65D 49/02* (2013.01)

(58) Field of Classification Search
CPC ..... B65D 47/00–47/123; B65D 47/043; B65D 47/20; B65D 49/02
(Continued)

(56) References Cited

U.S. PATENT DOCUMENTS 1,937,278 A 11/1933 Kleine
2,107,442 A 2/1938 Hughes
(Continued)

FOREIGN PATENT DOCUMENTS

EP 0 384 394 A2 8/1990
GB 2 169 210 A 7/1986

OTHER PUBLICATIONS

The Dr. Brown's® Specialty Feeding System, Dr. Brown's Medical, https://www.drbrownsbaby.com/medical/products/specialty-feeding/ (retrieved on Jun. 13, 2017).
(Continued)

*Primary Examiner* — Kareen K Thomas
(74) *Attorney, Agent, or Firm* — Nixon & Vanderhye P.C.

(57) ABSTRACT

An insert may be used with a container that includes a lid with a suction opening and a liquid storage portion where the lid threads onto the liquid storage portion to allow liquid from the liquid storage portion to be consumed through the suction opening by a user. The insert includes a barrier with an outer perimeter that is configured to be captured, and form a seal against liquid, between the lid and the liquid storage portion when the lid is threaded onto the liquid storage portion; a first one-way valve through the barrier and configured to allow the liquid to flow from the liquid storage portion to the suction opening during consumption of the liquid by the user; and a second one-way valve configured to allow air to flow into the liquid storage portion.

20 Claims, 6 Drawing Sheets

(51) Int. Cl.
*B65D 47/04* (2006.01)
*B65D 49/02* (2006.01)

(58) Field of Classification Search
USPC ..... 220/202–203.29; 215/11.1–11.6
See application file for complete search history.

(56) References Cited

U.S. PATENT DOCUMENTS

| | | | |
|---|---|---|---|
| 2,372,281 | A | 3/1945 | Jordan |
| 2,745,568 | A | 5/1956 | Newton |
| 2,812,092 | A | 11/1957 | Witz |
| 2,876,772 | A | 3/1959 | Witz |
| 2,876,773 | A | 3/1959 | Witz |
| 2,959,314 | A | 11/1960 | Sanchez |
| 2,987,209 | A | 6/1961 | Royal |
| 3,207,349 | A | 9/1965 | Rabe |
| 3,211,315 | A | 10/1965 | Griesinger |
| 3,635,380 | A | 1/1972 | Fitzgerald |
| 4,241,768 | A | 12/1980 | Keller et al. |
| 4,339,046 | A | 7/1982 | Coen |
| 4,754,887 | A | 7/1988 | Ou |
| 4,856,995 | A | 8/1989 | Wagner |
| 5,071,017 | A | 12/1991 | Stuli |
| 5,150,800 | A | 9/1992 | Sarter et al. |
| 5,234,117 | A | 8/1993 | Garvin |
| 5,433,328 | A | 7/1995 | Baron et al. |
| 5,474,193 | A | 12/1995 | Larsson et al. |
| 5,553,726 | A | 9/1996 | Park |
| 5,747,083 | A | 5/1998 | Raymond et al. |
| 5,791,503 | A | 8/1998 | Lyons |
| 5,860,541 | A | 1/1999 | McIntyre et al. |
| 5,897,007 | A | 4/1999 | Schein et al. |
| 5,938,053 | A | 8/1999 | Verbovszky et al. |
| 5,983,965 | A | 11/1999 | Patrick |
| 6,042,850 | A | 3/2000 | Ida et al. |
| 6,050,445 | A | 4/2000 | Manganiello |
| 6,112,919 | A | 9/2000 | Ho |
| 8,636,158 | B2 | 1/2014 | Frisch |
| 9,033,167 | B1 | 5/2015 | Pineda et al. |
| 9,241,588 | B2 | 1/2016 | Dunn et al. |
| 2001/0020623 | A1 | 9/2001 | McDonough et al. |
| 2002/0063103 | A1 | 5/2002 | Kiernan |
| 2004/0035815 | A1 | 2/2004 | Webb et al. |
| 2004/0211745 | A1 | 10/2004 | Murray |
| 2004/0245203 | A1 | 12/2004 | Goldman et al. |
| 2005/0154357 | A1* | 7/2005 | Pinel ..... A61J 9/00 604/247 |
| 2005/0247660 | A1 | 11/2005 | Michalopoulos |
| 2007/0163983 | A1* | 7/2007 | Hsu ..... A61J 11/002 215/11.1 |
| 2016/0193116 | A1* | 7/2016 | Ridley ..... A61J 9/001 215/11.4 |

OTHER PUBLICATIONS

LATCH™ Replacement Valves—2 Pack, Munchkin, http://www.munchkin.com/2pk-latchtm-replacement-valves.html (retrieved on Apr. 25, 2016).

Mizuno et al., "Changes in Sucking Performance from Nonnutritive Sucking to Nutritive Sucking during Breast- and Bottle-Feeding," http://www.nature.com/pr/journal/v59/n5/full/pr2006155a.html (retrieved on Apr. 25, 2016).

Spill Spoiler Cap, Red/Green/Royal Blue, 3-Count, Spill Spoiler, https://www.amazon.com/dp/B00AF2QIS6/ref=cm_sw_r_cp_T1_SXWpzbS6PWZ88 (retrieved on Apr. 25, 2016).

* cited by examiner

INSERT TO REDUCE LIKELIHOOD OF CONTAMINATION THROUGH BACKWASH AND CONTAINER WITH SAME

This application claims the benefit of U.S. Provisional Application No. 62/349,733, filed Jun. 14, 2016, and U.S. Provisional Application No. 62/409,463, filed Oct. 18, 2016, each of which is incorporated herein by reference in its entirety.

BACKGROUND

A portion of the population continue to use plastic bottles to consume liquids and in many cases store partially consumed bottles for later use. This behavior leads to bacterial contamination and growth in the unused liquid. In some cases, such as through baby or infant use, it may not be hygienic to expose the individual to potentially contaminated liquid.

As part of increased awareness to protect the environment, there is enhanced focus on eco-friendly behavior. With this focus, particularly related to beverage consumption, individuals are choosing reusable liquid bottles. Consuming the remaining liquid in bottles can present health risks related to ingesting liquid with bacteria growth from backwash. In response to this issue, there are items that reduce the backflow of liquid into the bottle through the use of one-way valves (Drinking Container with One-way valve disclosed in U.S. Patent Application Publication No. 20060/0163187A1 and Airless baby bottle disclosed in U.S. Patent Application Publication No. 2011/0297634A1) and filtration systems (Reusable water bottle with disposable cap and filter disclosed in U.S. Pat. No. 8,845,895). However, these devices may still expose the contents of the bottle to bacteria transported through the physical contact with the individual's lips.

Parents spend extra money and effort annually by wasting unused infant formula and/or breast milk after their child only consumes a portion of the liquid in the bottle. Once this liquid is contaminated by the individual's first 'sip' from the bottle, it must be discarded within a specific time frame.

BRIEF SUMMARY

The present technology may address one or more of the disadvantages of the prior art. For example, the present technology may address the issue of both bacterial contamination from backwash (backflow of liquid) and as well as bacterial contamination from physical contact with individual's lips. The present technology may not only address the issue with bottles of infant formula and breast milk but also can be applied to reusable adult liquid bottles. The present technology may also be used with food pouches.

The present technology may include a one-way valve and reservoir in an effort to reduce the amount of contaminated liquid in physical contact with non-consumed liquid in containers such as bottles. One or more examples may isolate and/or separate the contaminated fluid thereby allowing the unused, non-contaminated fluid to be stored and/or reused at a later time.

An example of the present technology includes an insert for use with a container that includes a lid with a suction opening and a liquid storage portion where the lid threads onto the liquid storage portion to allow liquid from the liquid storage portion to be consumed through the suction opening by a user. The insert comprises a barrier with an outer perimeter that is configured to be captured, and form a seal against liquid, between the lid and the liquid storage portion when the lid is threaded onto the liquid storage portion; a first one-way valve through the barrier and configured to allow the liquid to flow from the liquid storage portion to the suction opening during consumption of the liquid by the user; and a second one-way valve configured to allow air to flow into the liquid storage portion.

In examples, (a) the barrier is configured to form a chamber with the lid, the chamber is in fluid communication with the first one-way valve and the suction opening, and the chamber is not in fluid communication with the second one-way valve; (b) the first one-way valve is a duck bill check valve; (c) the second one-way valve is not a duck bill check valve; (d) the second one-way valve is a reed valve; (e) the barrier, the first one-way valve and the second one-way valve are parts of a unitary molded body; (f) the first one-way valve is configured to open with a differential pressure between 0 and 0.14 psi; (g) the second one-way valve is configured to provide fluid communication from the threads to the storage portion; (h) the insert is configured so that external fluid can flow from the threads, to the second one-way valve and into the storage portion when the barrier is between the lid and the liquid storage portion but fluid cannot flow from the threads to the suction opening when the barrier is between the lid and the liquid storage portion without first flowing into the liquid storage portion; (i) the second one-way valve is configured to allow external air to flow into the liquid storage portion during consumption of the fluid by the user; (j) the second one-way valve is configured so that when the container is inverted and the liquid contacts the second one-way valve, sealing force of the second one-way valve is increased due to the weight of the fluid; and/or (k) the first one-way valve is configured to open due to the weight of the liquid on the first one-way valve when the container is inverted, there is no liquid below the insert and the user does not provide suction.

Another example of the present technology includes flow control device comprising: a barrier with an outer-most annular portion configured to form a seal against liquid when compressed between opposed members; a first one-way valve configured to provide fluid communication from a first side of the barrier to a second side of the barrier; and a second one-way valve configured to provide fluid communication from a radially outer-most surface of the barrier to the first side of the barrier. The barrier is impermeable to liquid except through the first one-way valve and the second one-way valve.

In examples, (a) the outer-most annular portion forms an uninterrupted perimeter of the barrier except at the second one-way valve, (b) the uninterrupted perimeter is cylindrical; and/or (c) the second one-way valve is at least partially within the outer-most annular portion.

Further examples may include (a) a bottle for nursing by an infant comprising a threaded lid with a nipple for nursing, a threaded body configured to store fluid; and the insert according to any preceding example compressed by and between the threaded lid and the threaded body; and/or (b) a beverage container comprising a threaded lid with an opening configured for removal of liquid by suction, a threaded body configured to store the liquid; and the insert according to any preceding example compressed by and between the threaded lid and the threaded body.

Other aspects, features, and advantages of this technology will become apparent from the following detailed description when taken in conjunction with the accompanying drawings, which are a part of this disclosure and which illustrate, by way of example, principles of this technology.

DETAILED DESCRIPTION

The following description is provided in relation to several examples which may share common characteristics and features. It is to be understood that one or more features of any one example may be combinable with one or more features of the other examples. In addition, any single feature or combination of features in any of the examples may constitute additional examples.

Throughout this disclosure, terms such as first, second, etc. may be used. However, these terms are not intended to be limiting or indicative of a specific order, but instead are used to distinguish similarly described features from one another, unless expressly noted otherwise. Terms such as substantially and about are intended to allow for variances to account for manufacturing tolerances, measurement tolerances, or variations from ideal values that would be accepted by those skilled in the art.

Figure 1A:
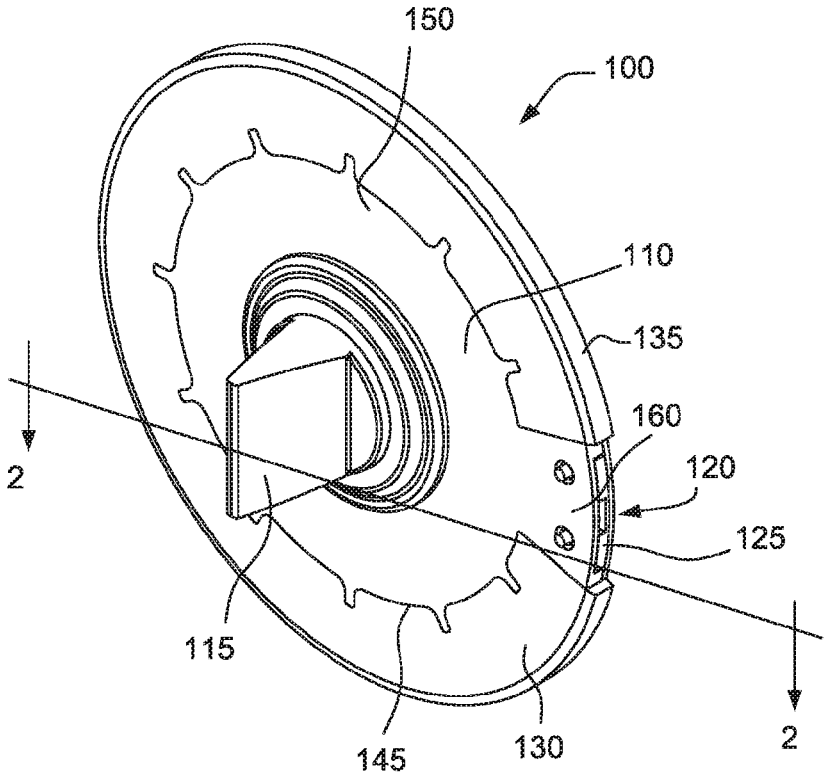
FIGS. 1A and 1B are views of opposite sides of an insert described herein.
Figure 1B:
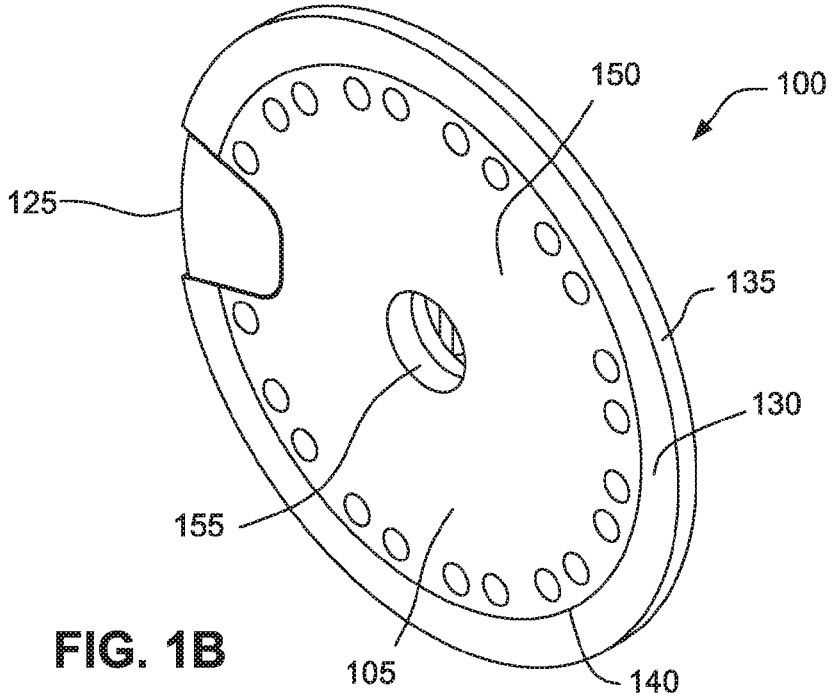

FIGS. 1A and 1B illustrates an insert 100 with a first side 105 and a second side 110. A first one-way valve 115, illustrated as a duck bill valve, is oriented to allow fluid flow from the first side 105 to the second side 110, but prevent flow in the reverse direction. A second one-way valve 120 is oriented to allow fluid flow from a radial edge 125 to the first side 105.

An outer annular portion 130 of the insert 100 extends from an outer-most radial edge 135 to a first intermediate radial position 140 on the first side 105 and to a second intermediate radial position 145 on the second side. The outer annular portion 130 is preferably made from a material that is suitable for being compressed to form a fluid-tight seal, such as a thermoplastic elastomer. One example is VERSAFLEX™ CL2250 available from GLS Thermoplastic Elastomers.

A first intermediate annular portion 150 abuts the outer annular portion 130 at the first intermediate radial position 140 and the second intermediate radial position 145 and includes a central opening 155 that provides fluid communication to the first one-way valve 115.

Figure 2:
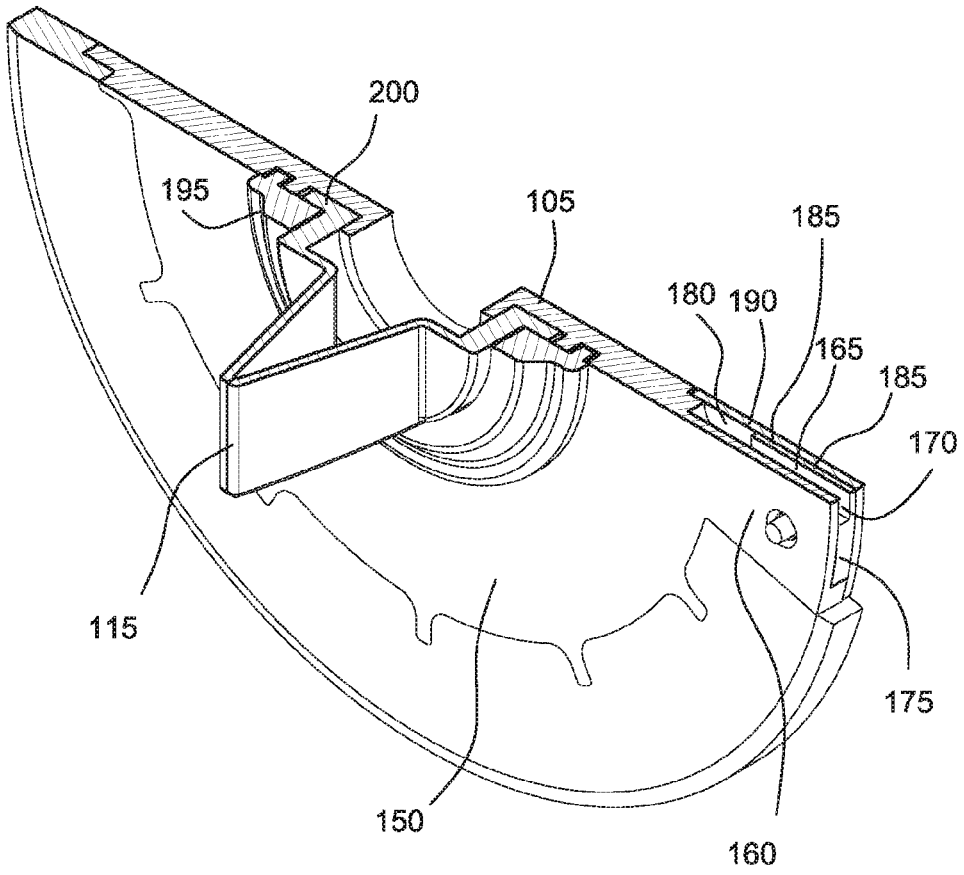
FIG. 2 is a cross-sectional view taken through FIG. 1A along line II-II.
Figure 3:
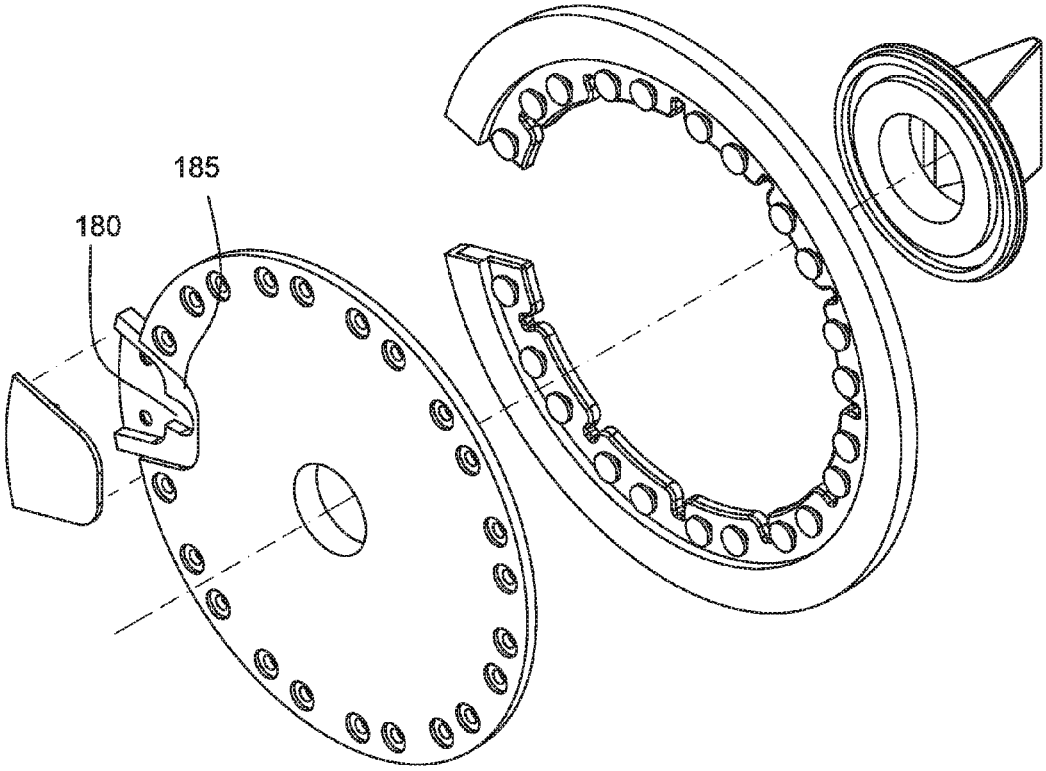
FIG. 3 is an exploded view of sub-components of the insert.
Figure 4:
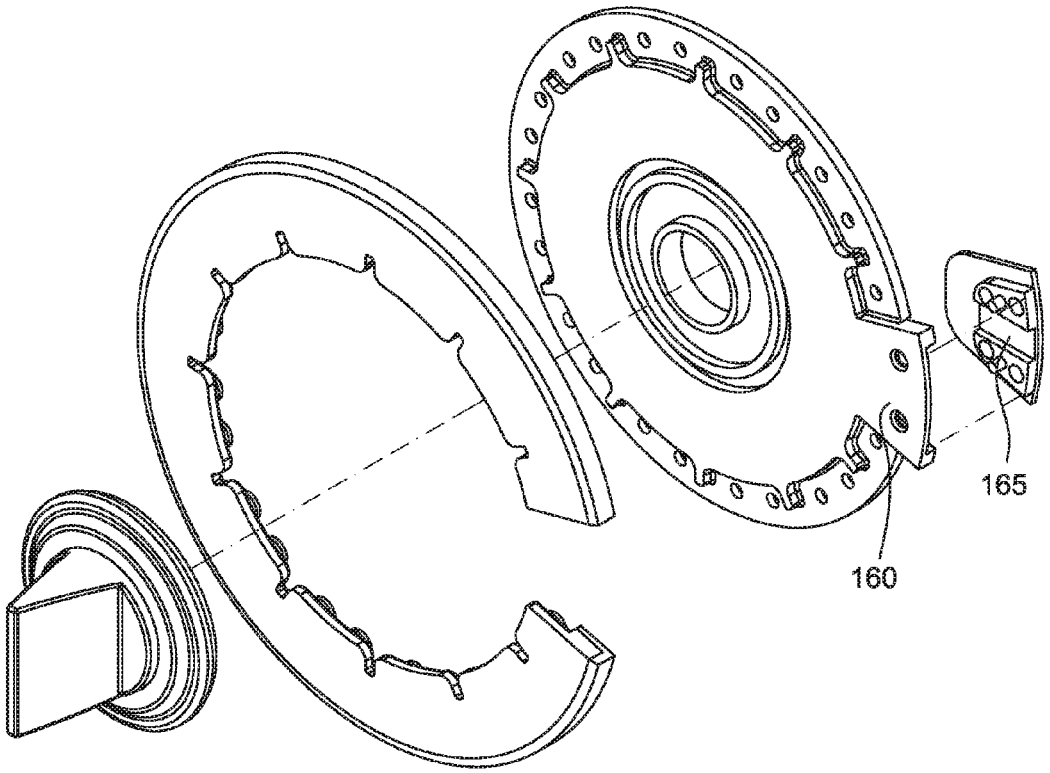
FIG. 4 is another exploded view of sub-components of the insert.

Referring to FIGS. 2-4, a portion 160 of the first intermediate annular portion 150 extends radially beyond the first intermediate radial position 140 and the second intermediate radial position 145 and includes a passage 165 from an opening 170 on a radial exterior surface 175 to an opening 180 on a facing surface 185 that faces in the same direction as the first side 105. A flap 190 covers the opening 180. The flap 190 can be part of the outer annular portion 130 or can be a separate component. The passage 165 and the flap 190 form the second one-way valve 120, which is one example of a reed valve.

The first intermediate annular portion 150 is connected to the outer annular portion 130 by insert molding these two components together, but any suitable connection method, such as heat staking, ultrasonic welding or connecting with adhesive, may be used instead so long as an adequate liquid seal is achieved. Alternatively, the first intermediate annular portion 150 and the outer annular portion 130 could be formed as a single component. The flap 190 may also be attached to the first intermediate annular portion 150 by any suitable method, such as insert molding, heat staking, ultrasonic welding or connecting with adhesive.

As best seen in FIG. 2, a second intermediate annular portion 195 is attached to the first intermediate annular portion 150 to retain an annular rim 200 of the first one-way valve 115. The second intermediate annular portion 195 is attached to the first intermediate annular portion 150 by ultrasonic welding, but any suitable connection method, such as adhesive or heat staking, may be used instead so long as an adequate liquid seal is achieved. With this configuration, a commercially available valve can be used for the first one-way valve. However, it is also possible to combine one or more of the outer annular portion 130, the first intermediate annular portion 150, the second intermediate annular portion 195 and the first one-way valve 115 into a single, unitary part. This may be achieved, for example, by molding some or all of these components simultaneously from a single, continuous material in a single mold cavity.

Figure 5:
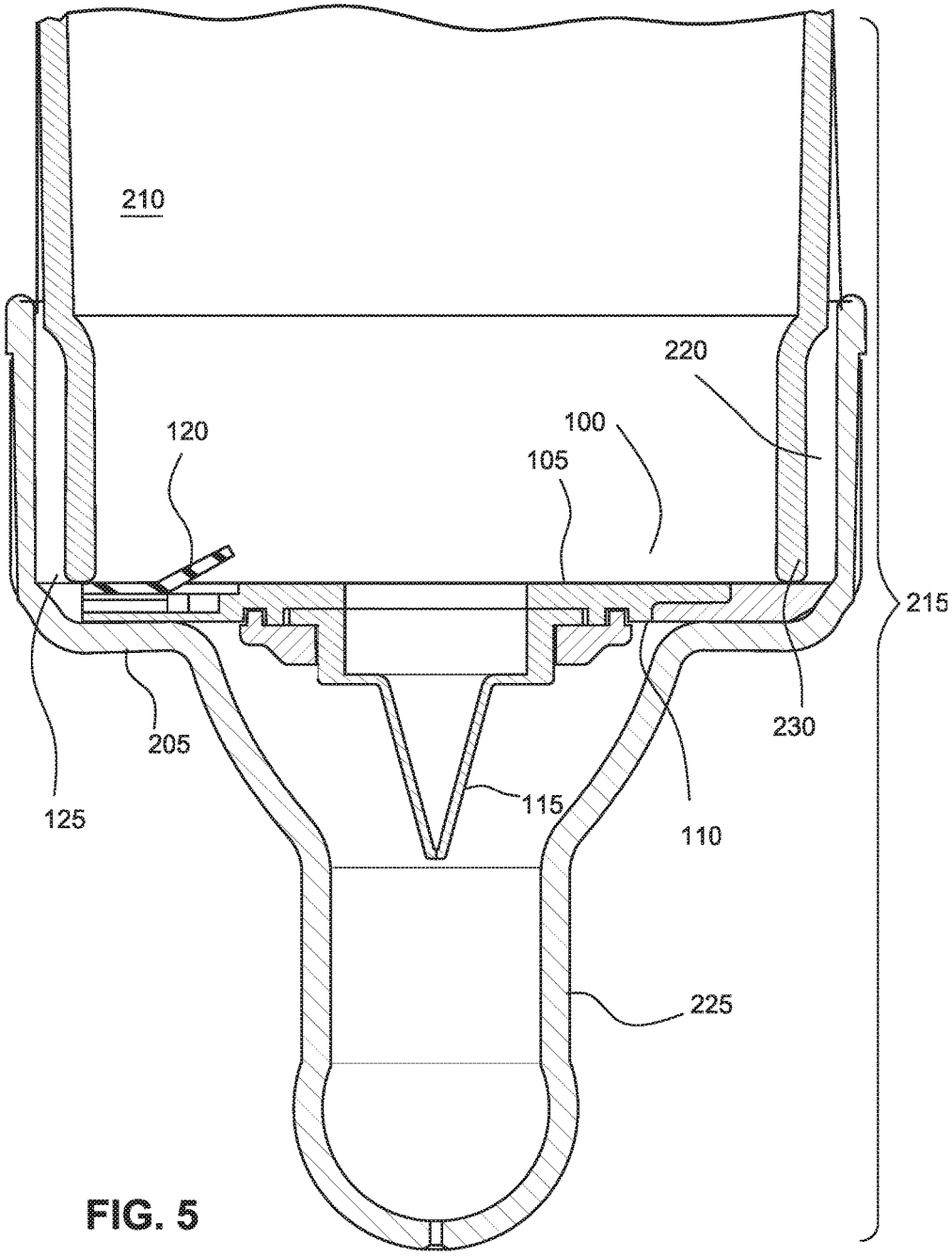
FIG. 5 is a view of the insert retained in a bottle.

FIG. 5 illustrates the insert 100 captured between a lid 205 and a liquid storage portion 210 of a bottle 215 (an example of a container), where the lid 205 and liquid storage portion 210 are fastened together at threads 220. The lid 205 includes a nipple 225 to allow a user to suck fluid out of the bottle; however, the nipple 225 could be replaced with a straw or other opening that allows suction such as in a so-called "sippy cup."

The insert 100 captured between the lid 205 and the liquid storage portion 210 serves as a barrier that prevents liquid from passing backwards into the liquid storage portion 210, i.e., prevent backwash. The space between the insert 100 and the lid 205 may effectively form a separate storage volume or reservoir that allows mixing of backwash and uncontaminated liquid without contaminating, or at least reducing contamination of, liquid in the liquid storage portion 210. By preventing backwash, contaminants such as bacteria should not enter the liquid stored in the liquid storage portion 210 and thus any unused liquid can be stored for later use. With the disclosed insert 100, microbiological testing demonstrated at least 99.6% effectiveness (and as high as 99.98% effectiveness) in preventing backflow into the liquid storage portion 210 and thus resulted in reduced contamination versus without using the insert 100. Prevention of contamination can be very important for expensive or scarce liquids such as baby formula or breast milk. Prevention of contamination can also be desirable for improved hygiene in general.

The first one-way valve 115 is illustrated as a duck bill valve, which may have certain advantages. For example, a duck bill valve may have a relatively low cracking pressure, and the cracking pressure may be effectively zero when the bottle 215 is inverted due to the weight of the liquid tending to open the valve. Such a low cracking pressure is desirable because the insert 100 can be used in baby bottles without negatively impacting the performance of the baby bottle, and thus the insert 100 can be used in off the shelf bottles without impacting their performance. For example, "Changes in Sucking Performance from Nonnutritive Sucking to Nutritive Sucking during Breast- and Bottle-Feeding" by Mizuno et al. (available at http://www.nature.com/pr/journal/v59/n5/full/pr2006155a.html) shows that nutritive sucking pressure when bottle feeding ranges from −15.3 kPa (−114.6 mm Hg) to −8.35 kPa (−62.6 mm Hg). Testing using an embodiment of the insert 100 with a duck bill valve resulted in differential cracking pressures between 0 kPa and 0.97 kPa (0 psi to 0.14 psi), whereas a comparable umbrella valve resulted in differential cracking pressures between 0.3 kPa and 6 kPa. With the lowest nutritive sucking pressure of 8.35 kPa and the worst case umbrella valve cracking pressure of 6 kPa, about 72% of the sucking pressure would be required just to open the umbrella valve. A low cracking pressure may be less likely to induce colic in a baby using a bottle with the insert 100 while nursing. A low cracking pressure may also allow the space between the insert 100 and the lid 205 to be primed or filled by inverting a full bottle 215. With a sufficiently low cracking pressure, inverting the bottle can cause the first one-way valve 115 to crack open from pressure caused by the weight of liquid, which will result in the fluid filling the space between the insert 100 and the lid 205, resulting in the bottle being primed and ready for consumption.

Although a duck bill valve has been demonstrated as effective, other types of one-way valves may be employed, particularly if a low cracking pressure can be achieved or if low cracking pressure is not necessary. For example, an insert 100 intended for adult use may allow, or even prefer, a higher cracking pressure.

Figure 6:
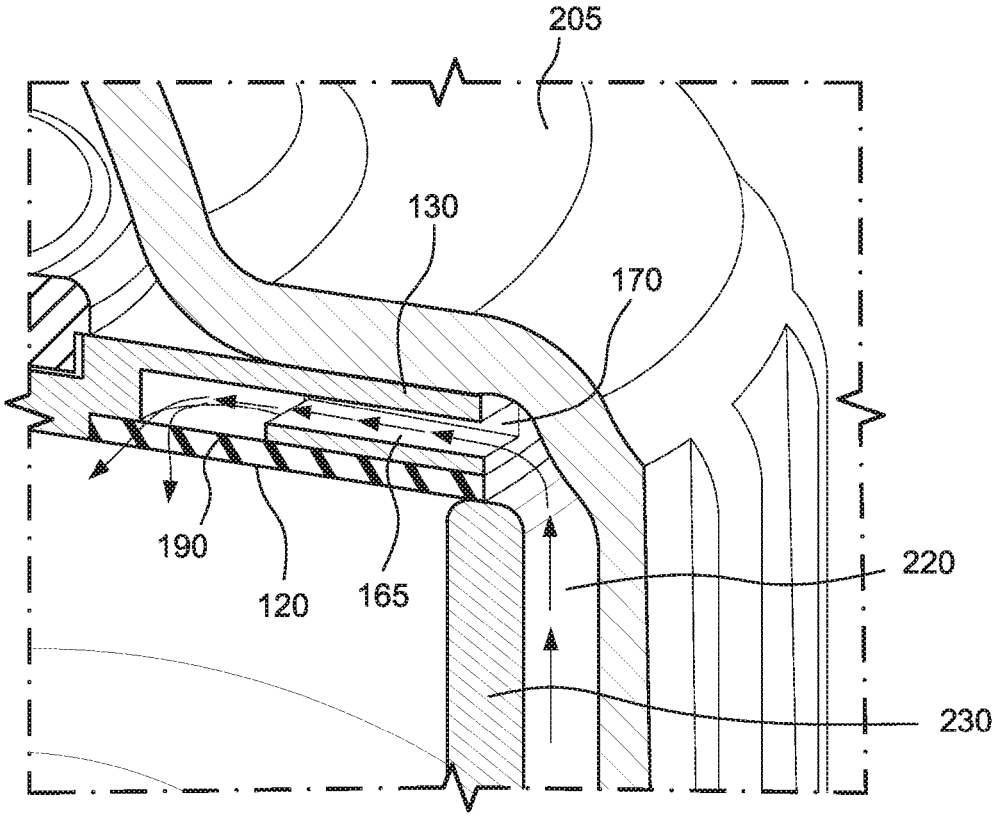
FIG. 6 is a cross-sectional view of the insert retained in the bottle.

The location and inclusion of the second one-way valve 120 is relevant to both prevention of contamination and reduction in pressure required to remove liquid from the liquid storage portion 210. As best seen in FIG. 6, the opening 170 is in fluid communication with a gap adjacent the threads 220. The threads 220 apply a mechanical force that generates a seal between the lid 205 and a rim 230 of the liquid storage portion 210, but the threads 220 do not generate a seal. Thus when the outer annular portion 130 is compressed between the lid 205 and the rim 230 to form a seal, air can flow through the threads and into the opening 170 and into the passage 165. When a negative pressure exists in the liquid storage portion 210 relative to ambient pressure, a differential will exist across the flap 190 that tends to urge the flap 190 open. When the differential pressure is sufficient to bend the flap 190, air will flow into the liquid storage portion 210 until the pressure in the liquid storage portion 210 is equal to ambient pressure and then the flap 190 will close. In this way, it is unlikely that sufficient vacuum can be generated in the liquid storage portion 210 to unduly increase the cracking pressure of the first one-way valve 115. Also, because the air flow path is through the threads 220 and not from the second side 110, equalizing pressure should not result in backwash and thus is less likely to cause contamination of liquid in the liquid storage portion 210.

The position and structure of the second one-way valve 120 may tend to increase the sealing effectiveness of the second one-way valve 120. For example, when the bottle 215 is upright, gravity will prevent flow of liquid out of the second one-way valve 120 from the liquid storage portion 210 (e.g., because liquid does not flow against gravity) and any liquid retained on the second side 110 has no flow path to the second one-way valve 120. When there is fluid in the liquid storage portion 210 and the bottle 215 is inverted, the weight of the fluid will press down on the flap 190, which will increase the pressure applied to the flap 190 and increase the sealing effectiveness of the flap 190. Thus fluid should not leak out of the second one-way valve 120.

Preferably the thickness of the outer annular portion 130 is sufficiently small that the insert 100 can be used with off the shelf products, such as baby bottles, without negatively impacting the ability of the lid 205 to thread onto the liquid storage portion 210.

The outer diameter of the outer annular portion 130 may be sized to loosely fit within the threads of the lid 205, so as to fall out if unconstrained, or may be sized to have at least some interference with the lid 205. With at least some interference, the insert 100 can be retained in the lid 205, which may have several advantages. First, the location of the insert 100 should be known when the lid 205 is removed, and thus the insert is less likely to be dropped or lost. Second, contaminated liquid may be retained between the lid 205 and the insertion 100 when the lid is removed, thus reducing the likelihood of contaminating liquid in the liquid storage portion 210. Interference between the insert 100 and the threads of the lid 205 can be achieved with an outer diameter that causes interference or one or more protrusions or tabs may be included to generate interference.

In an attempt to provide further ease of use for the user and prevent potential misuse, a portion of the one-way valve and reservoir device may be attached to the corresponding bottle lid or nipple. The attachment can be similar to a lanyard or tab fixed to the lid or nipple. Attaching or inserting the device when attached to the nipple may be performed in a similar manner as without being attached to the nipple. Attaching the device to the nipple may reduce the probability that the device will be used without a nipple.

Although most of the description above is directed to bottles with nipples (i.e., baby bottles), the present technology can also be applied in other applications to prevent contaminants (such as bacteria) from entering the main storage volume. For example, the present technology may be used in any container (baby bottles, water bottles, "sippy cups," etc.) and pouches (food and liquid). Indeed, the present technology is applicable to containers used to store and dispense products (such as liquids, gels and pastes) for human consumption, particularly where the container is intended to come into contact with the consumer (e.g., the consumer's mouth). As would be readily understood by those skilled in the art, the overall shape of the insert 100, and the way in which the insert 100 is retained, may be dictated by the container with which the insert is used. As described above, the container is a bottle with a threaded lid where one useful overall shape is circular. But use with an item such as a food pouch may require a different shape dictated by the shape of the food pouch and/or the opening through which food is removed from the pouch.

While the present technology has been described in connection with several practical examples, it is to be understood that the technology is not to be limited to the disclosed examples, but on the contrary, is intended to cover various modifications and equivalent arrangements included within the spirit and scope of the technology.

The invention claimed is:

1. An insert for use with a container that includes a lid with a suction opening and a liquid storage portion where the lid threads onto the liquid storage portion to allow liquid from the liquid storage portion to be consumed through the suction opening by a user, the insert comprising:

a barrier with an outer perimeter that is configured to be captured, and form a seal against liquid, between the lid and the liquid storage portion when the lid is threaded onto the liquid storage portion;

a first one-way valve through the barrier and configured to allow the liquid to flow from the liquid storage portion to the suction opening during consumption of the liquid by the user; and a second one-way valve configured to allow air to flow into the liquid storage portion, the second one-way valve being configured to provide fluid communication from the threads to the storage portion; wherein the insert is configured so that external fluid can flow from the threads, to the second one-way valve and into the storage portion when the barrier is between the lid and the liquid storage portion but fluid cannot flow from the threads to the suction opening when the barrier is between the lid and the liquid storage portion without first flowing into the liquid storage portion, and the insert is configured to be removably and repeatably inserted to be retained between the lid and the liquid storage portion at a location that the lid is able to seal against the liquid storage portion without the insert.

2. The insert according to claim 1, wherein the barrier is configured to form a chamber with the lid such that the chamber is in fluid communication with the first one-way valve and the suction opening, and the chamber is not in fluid communication with the second one-way valve.

3. The insert according to claim 1, wherein the first one-way valve is a duck bill check valve.

4. The insert according to claim 3, wherein the second one-way valve is not a duck bill check valve.

5. The insert according to claim 3, wherein the second one-way valve is a reed valve.

6. The insert according to claim 1, wherein the barrier, the first one-way valve and the second one-way valve are parts of a unitary molded body.

7. The insert according to claim 1, wherein the first one-way valve is configured to open with a differential pressure between 0 and 0.14 psi.

8. The insert according to claim 1, wherein the second one-way valve is configured to allow external air to flow into the liquid storage portion during consumption of the fluid by the user.

9. The insert according to claim 1, wherein the second one-way valve is configured so that when the container is inverted and the liquid contacts the second one-way valve, sealing force of the second one-way valve is increased due to the weight of the fluid.

10. The insert according to claim 1, wherein the first one-way valve is configured to open due to the weight of the liquid on the first one-way valve when the container is inverted, there is no liquid below the insert and the user does not provide suction.

11. A bottle for nursing by an infant comprising a threaded lid with a nipple for nursing;

a threaded body configured to store fluid; and the insert according to claim 1 compressed by and between the threaded lid and the threaded body.

12. A beverage container comprising a threaded lid with an opening configured for removal of liquid by suction;

a threaded body configured to store the liquid; and the insert according to claim 1 compressed by and between the threaded lid and the threaded body.

13. The insert according to claim 1, wherein the insert is a substantially flat disc except at the first one-way valve.

14. An insert for use with a container that includes a lid with a suction opening and a liquid storage portion where the lid threads onto the liquid storage portion to allow liquid from the liquid storage portion to be consumed through the suction opening by a user, the insert comprising:

a barrier with an outer perimeter that is configured to be captured, and form a seal against liquid, between the lid and the liquid storage portion when the lid is threaded onto the liquid storage portion;

a first one-way valve through the barrier and configured to allow the liquid to flow from the liquid storage portion to the suction opening during consumption of the liquid by the user, the first one-way valve being a duck bill check valve; and a second one-way valve configured to allow air to flow into the liquid storage portion, the second one-way valve being configured to provide fluid communication from the threads to the storage portion, the second one-way valve being a reed valve; wherein the barrier, the first one-way valve and the second one-way valve are parts of a unitary body;

the barrier is configured to form a chamber with the lid such that the chamber is in fluid communication with the first one-way valve and the suction opening, and the chamber is not in fluid communication with the second one-way valve;

the second one-way valve is configured to protrude into the chamber and thus reduce a volume of the chamber; and the insert is configured so that external fluid can flow from the threads, to the second one-way valve and into the storage portion when the barrier is between the lid and the liquid storage portion but fluid cannot flow from the threads to the suction opening when the barrier is between the lid and the liquid storage portion without first flowing into the liquid storage portion.

15. The insert according to claim 14, wherein the first one-way valve is configured to open with a differential pressure between 0 and 0.14 psi.

16. The insert according to claim 14, wherein the second one-way valve is configured to allow external air to flow into the liquid storage portion during consumption of the fluid by the user.

17. The insert according to claim 14, wherein the second one-way valve is configured so that when the container is inverted and the liquid contacts the second one-way valve, sealing force of the second one-way valve is increased due to the weight of the fluid.

18. The insert according to claim 14, wherein the first one-way valve is configured to open due to the weight of the liquid on the first one-way valve when the container is inverted, there is no liquid below the insert and the user does not provide suction.

19. A bottle for nursing by an infant comprising a threaded lid with a nipple for nursing;

a threaded body configured to store fluid; and the insert according to claim 14 compressed by and between the threaded lid and the threaded body.

20. A beverage container comprising a threaded lid with an opening configured for removal of liquid by suction;

a threaded body configured to store the liquid; and the insert according to claim 14 compressed by and between the threaded lid and the threaded body.

* * * * *